US006557791B2

(12) United States Patent
Mulgrew et al.

(10) Patent No.: US 6,557,791 B2
(45) Date of Patent: May 6, 2003

(54) WOODCHIPPER TOOL

(76) Inventors: Brian Mulgrew, P.O. Box 6574, Delray Beach, FL (US) 33484; Michael M. Anthony, 10189 W. Sample Rd., Coral Springs, FL (US) 33065

( * ) Notice: Subject to any disclaimer, the term of this patent is extended or adjusted under 35 U.S.C. 154(b) by 53 days.

(21) Appl. No.: 09/785,982

(22) Filed: Feb. 20, 2001

(65) Prior Publication Data

US 2002/0113153 A1 Aug. 22, 2002

(51) Int. Cl.[7] ..... B02C 18/22
(52) U.S. Cl. ..... 241/92; 81/488; 241/301
(58) Field of Search ..... 241/92, 282.1, 241/169.2, 301; 81/488

(56) References Cited

U.S. PATENT DOCUMENTS 3,088,345 A * 5/1963 Campbell ..... 241/245
3,765,275 A * 10/1973 Johnson ..... 15/105
4,397,427 A * 8/1983 Howard ..... 241/282.1
5,062,329 A * 11/1991 Connolly et al. ..... 241/169.2

* cited by examiner

*Primary Examiner*—Mark Rosenbaum
(74) *Attorney, Agent, or Firm*—Oltman, Flynn & Kubler

(57) ABSTRACT

A plant waste disposal system is further includes a wood chipper apparatus having plant waste fragmenting elements and having a plant waste receiving hopper; an elongate push member having a member first end for gripping by hand and having a member second end of at least twice the width of the member first end for abutting and pushing plant waste into the plant waste receiving hopper. The elongate push member preferably is formed of tool material which is biodegradable. The elongate member preferably is constructed to fracture when subjected to tensile force in excess of five pounds, for preventing the elongate member from pulling a worker hand into the plant waste fragmenting elements.

14 Claims, 12 Drawing Sheets

WOODCHIPPER TOOL

BACKGROUND OF THE INVENTION

1. Field of the Invention

The present invention relates generally to the field of devices for disposing of plant waste in the form of parts of plants, and primarily in the form of tree branches. More specifically the present invention relates to a pushing tool for manually pushing plant waste into the hopper of a conventional wood chipper apparatus which processes the waste by chopping or grinding it. The pushing tool includes a disposable elongate member made of biodegradable material having a member first end narrow enough for gripping by hand and having a member second end significantly wider than the member first end for abutting and pushing plant waste into a plant waste receiving hopper. The pushing tool is constructed, either by choice of a suitable material or by its configuration, so that the member second end breaks away when the member is placed under substantial tensile loading. As a result, in the event the member accidently becomes caught in the chipper apparatus and is suddenly pulled into the apparatus plant waste fragmenting elements, the member second end simply breaks away from the member first end so that the worker hand gripping the member first end is not pulled into the plant waste fragmenting elements. The tool material is also sufficiently soft and fragile that a conventional wood chipper apparatus can chop or shred it without damage to the plant waste fragmenting elements.

2. Description of the Prior Art

The wood chipper apparatus has been standard equipment for chopping and grinding tree branches and other wood and plant fragments for compact transport to disposal and recycling sites for many years. A problem with using a wood chipper apparatus has been the danger of injury resulting from worker hands and arms being caught and pulled into the plant waste fragmenting elements, since workers often push the wood and plant waste into the plant waste fragmenting elements with their hands. One attempted solution to this safety hazard has been the use by workers of any available board or branch to push waste into the plant waste fragmenting elements. A problem with using random boards and branches has been that they often are not conveniently shaped at their proximal ends for hand gripping and are not wide enough at their distal ends to push against waste efficiently. These make-shift tools may simply slide between branches and other debris rather than pushing it into the wood chipper apparatus. Another problem has been that the distal end of the board or branch can become accidently caught in the plant waste fragmenting elements of the wood chipper apparatus and suddenly pulled into it, sometimes pulling the hand of the worker into the plant waste fragmenting elements with it.

It is thus an object of the present invention to provide a pushing tool for pushing plant waste into the hopper of a wood chipper apparatus so that worker hands remain safely distanced from plant waste fragmenting elements.

It is another object of the present invention to provide such a pushing tool which is wider at the tool distal end than at the tool proximal end to more efficiently and broadly push waste into the wood chipper apparatus.

It is still another object of the present invention to provide such a pushing tool which will break apart when placed in substantial tensile loading so that the tool will not draw a worker hand into the wood chipper apparatus if the tool is suddenly caught and pulled into the plant waste fragmenting elements.

It is finally an object of the present invention to provide such a pushing tool which is disposable, readily choppable in a wood chipper, biodegradable and highly inexpensive to manufacture.

SUMMARY OF THE INVENTION

The present invention accomplishes the above-stated objectives, as well as others, as may be determined by a fair reading and interpretation of the entire specification.

A pushing tool is provided for manually pushing plant waste into a plant waste receiving hopper of a wood chipper apparatus, including an elongate member having a member first end for gripping by hand and having a member second end of at least one and one half times the cross-sectional area of the member first end for abutting and pushing plant waste into a plant waste receiving hopper constructed to fracture when subjected to tensile force in excess of five pounds, for preventing the elongate member from pulling a worker hand into the plant waste fragmenting elements.

A plant waste disposal system is further provided, including a wood chipper apparatus having plant waste fragmenting elements and having a plant waste receiving hopper; an elongate push member having a member first end for gripping by hand and having a member second end of at least one and one half times the cross-sectional area of the member first end for abutting and pushing plant waste into the plant waste receiving hopper. The elongate push member preferably is formed of tool material which is biodegradable. The elongate member preferably is constructed to fracture when subjected to tensile force in excess of five pounds, for preventing the elongate member from pulling a worker hand into the plant waste fragmenting elements. The elongate member preferably is constructed of tool material which is sufficiently soft and fragile that the wood chipper apparatus can fragment the elongate member without damage to the plant waste fragmenting elements.

The elongate member optionally is shaped as a hollow frusticone having a narrower end defining the member first end for hand gripping and a wider end defining the member second end for broadly bearing against plant waste and pushing the waste into the plant waste receiving hopper. The elongate member optionally has a cross-sectional shape which is substantially one of: elliptical and triangular and rectangular. The member first end optionally is a shaft of substantially uniform cross-section and the member second end optionally flares outwardly from the member first end to define a hollow and open based pyramid.

The elongate member optionally is substantially planar and optionally has a member first end of substantially continuous first end cross-section, has a member middle segment of substantially continuous rectangular cross-section which is wider than the first end cross-section, optionally and has a member second end including a broad region having generally rectangular opposing faces and a second end distal edge including a series of teeth for engaging plant waste to help the worker guide the plant waste into the plant waste receiving hopper. The broad region optionally flares progressively outwardly from the member first end to define substantially triangular opposing faces, the widest portion of the broad region being located at the second end distal edge for broadly abutting and pushing plant waste.

The elongate member optionally includes a member first end in the form of a smaller diameter first tube segment having a first tube segment proximal end and a first tube segment distal end, and a member second end in the form of a larger diameter second tube segment having a second tube segment proximal end axially joined to the first tube segment distal end and having a second tube segment distal end. The first tube segment preferably has a cross-section which is substantially one of: circular and elliptical. The second tube segment preferably has a cross-section which is substantially one of: circular and elliptical. This plant waste disposal system preferably additionally includes several substantially mutually parallel and laterally abutting filler tubes extending substantially parallel to the elongate member and contained within the second tube segment, for increasing the compressive strength and buckling limit of the second tube segment. The plant waste disposal system preferably still additionally includes several mutually parallel and abutting filler tubes extending parallel to the elongate member and contained within the first tube segment, for increasing the compressive strength and buckling limit of the first tube segment.

The elongate member preferably is formed of at least one of: cardboard, compressed pulp, compressed paper, layered wood, compressed wood, wood fiber, biodegradable plastic sheets, rolled paper, layered paper and drywall material.

The first tube segment distal end preferably is releasibly joined to the second tube segment proximal end so that compressive force borne by the second tube segment is directly transmitted into the first tube segment, and a tensile force in excess of five pounds causes the first tube segment to break away from the second tube segment upon the second tube segment becoming caught in the plant waste fragmenting elements while the first tube segment is gripped by a worker wood.

BRIEF DESCRIPTION OF THE DRAWINGS

Various other objects, advantages, and features of the invention will become apparent to those skilled in the art from the following discussion taken in conjunction with the following drawings, in which.

DETAILED DESCRIPTION OF THE PREFERRED EMBODIMENTS

Figure 1:
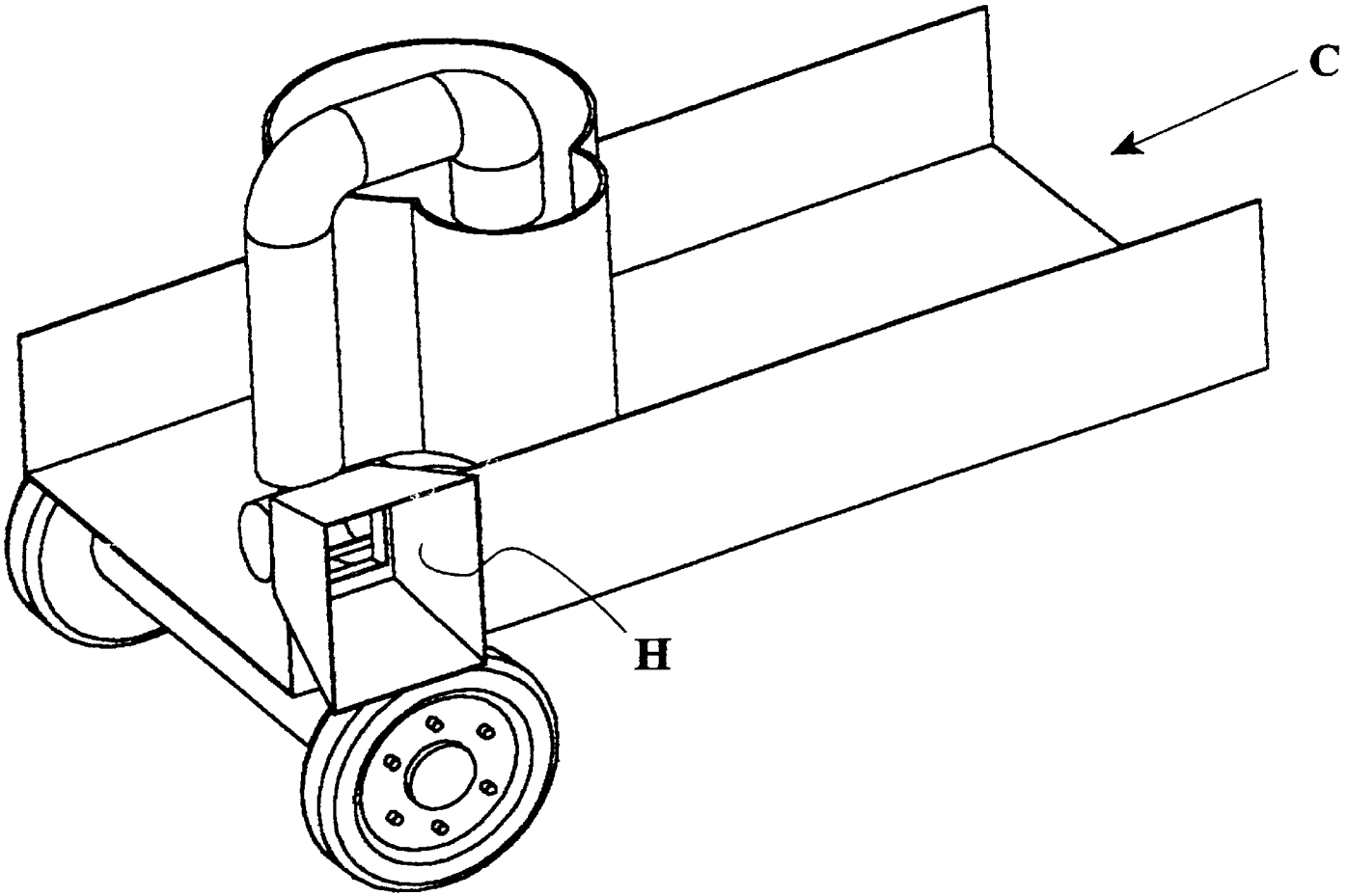
FIG. 1 is a perspective view of a typical existing wood chipper apparatus.
Figure 2:
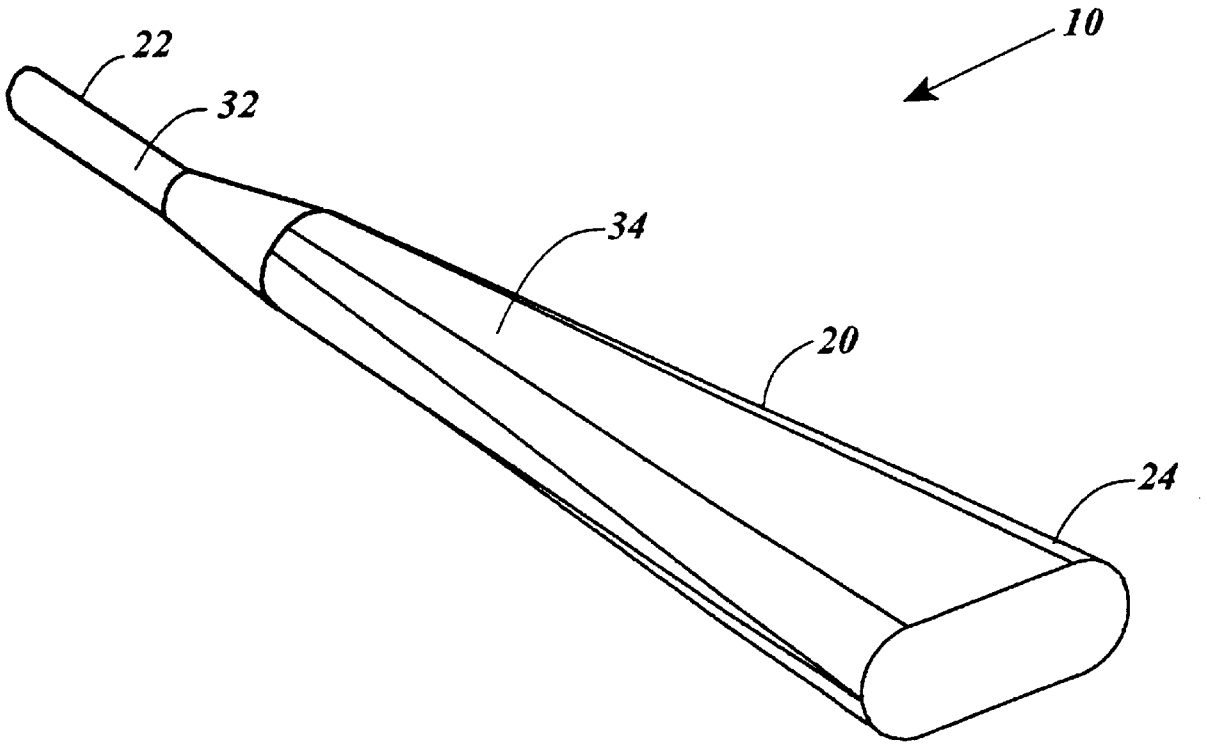
FIGS. 2–4 is a perspective view of the pushing tool of the first embodiment.
Figure 3:
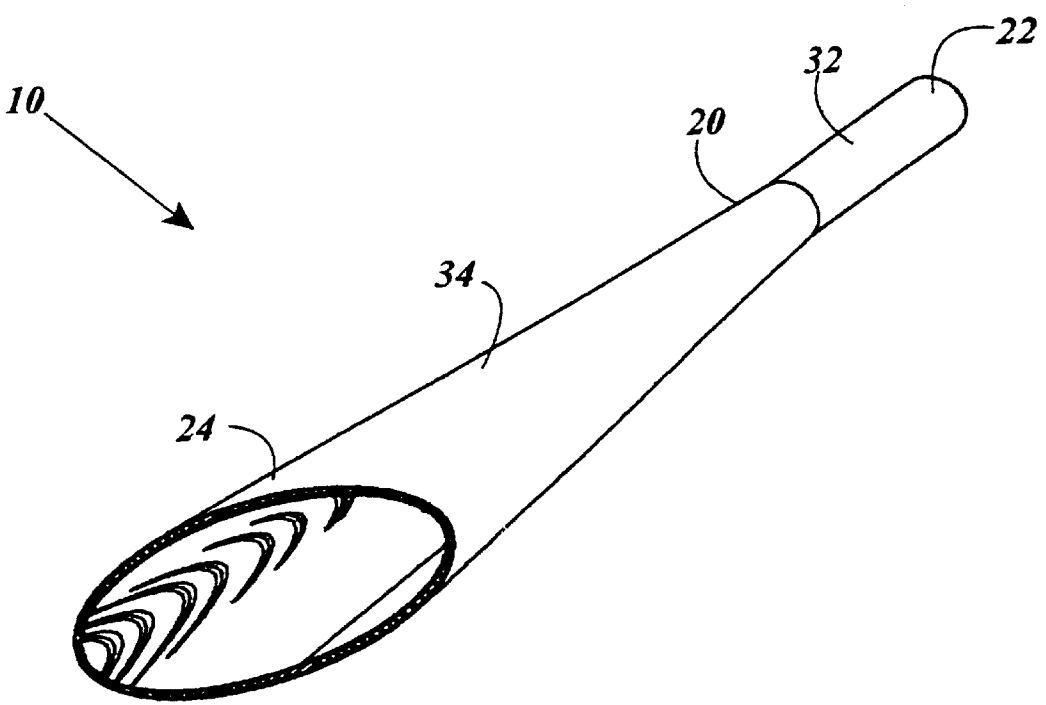
Figure 4:
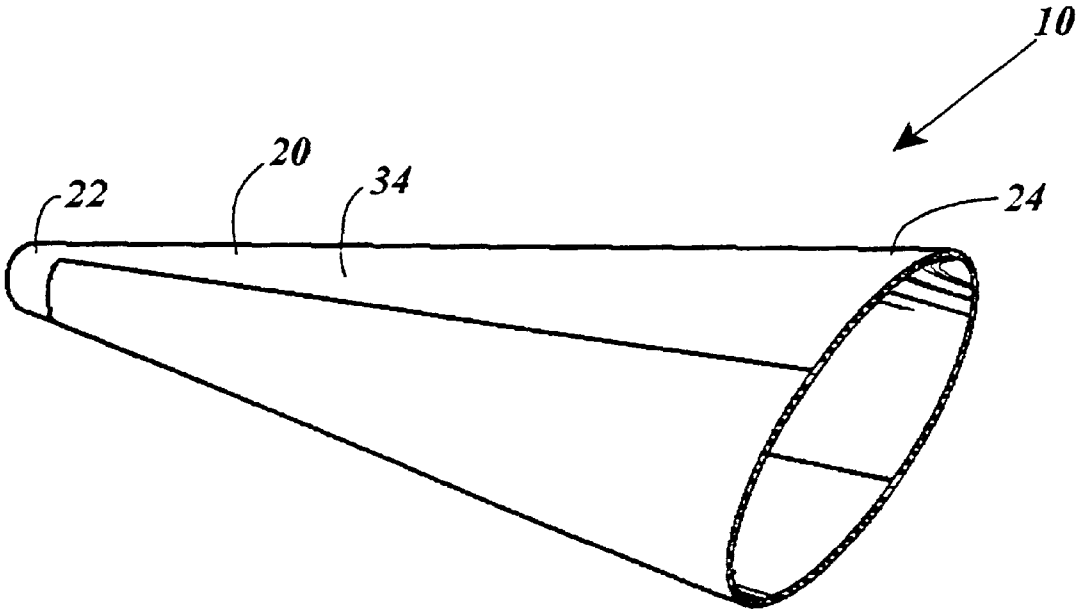
Figure 5:
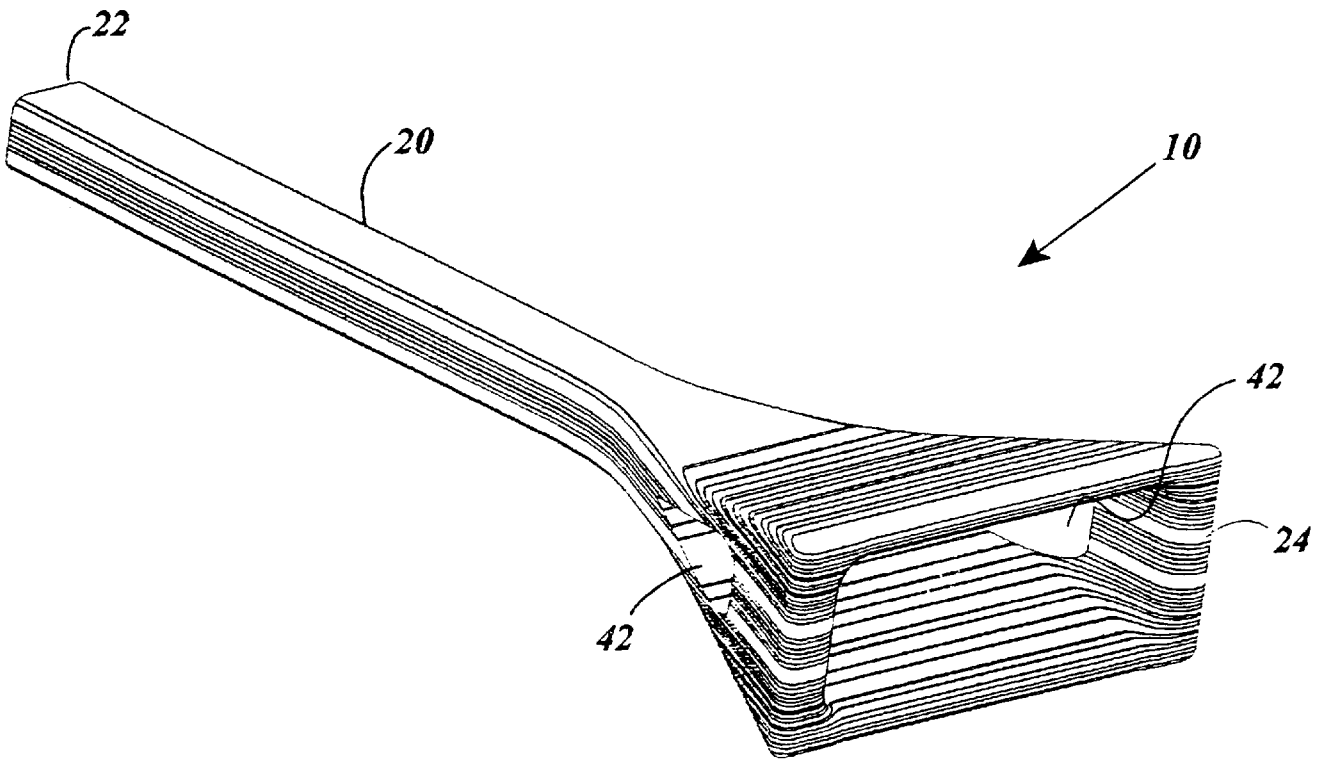
FIG. 5 is a distal end view of the pushing tool of the second embodiment.
Figure 6:
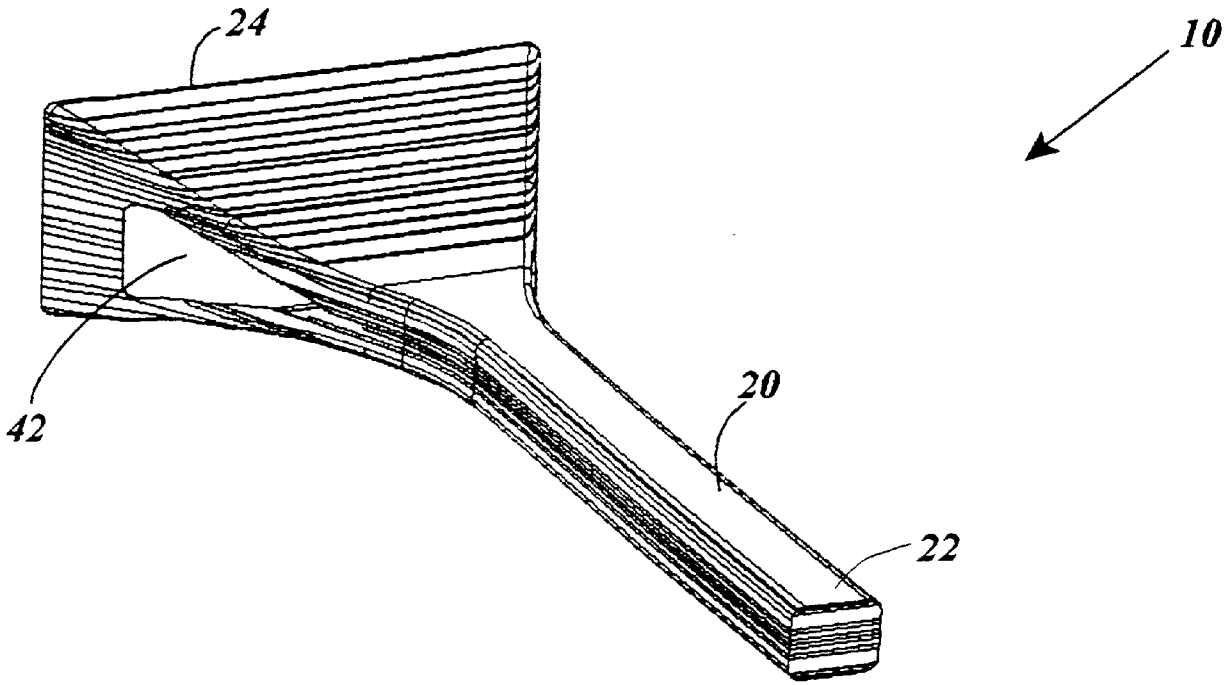
FIG. 6 is a proximal end view of the pushing tool of the second embodiment.
Figure 7:
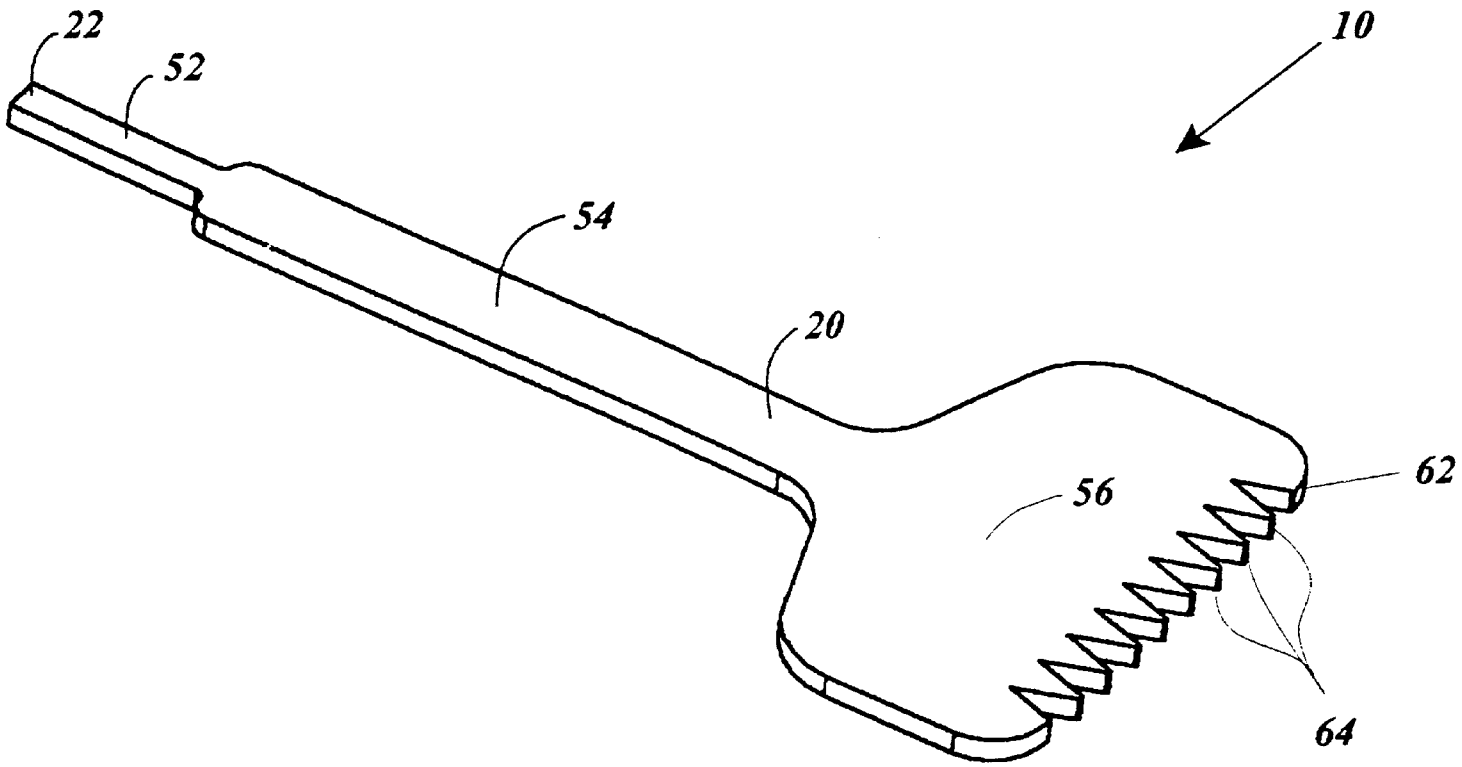
FIG. 7 is a distal perspective view of the pushing tool of the first version of the third embodiment.
Figure 8:
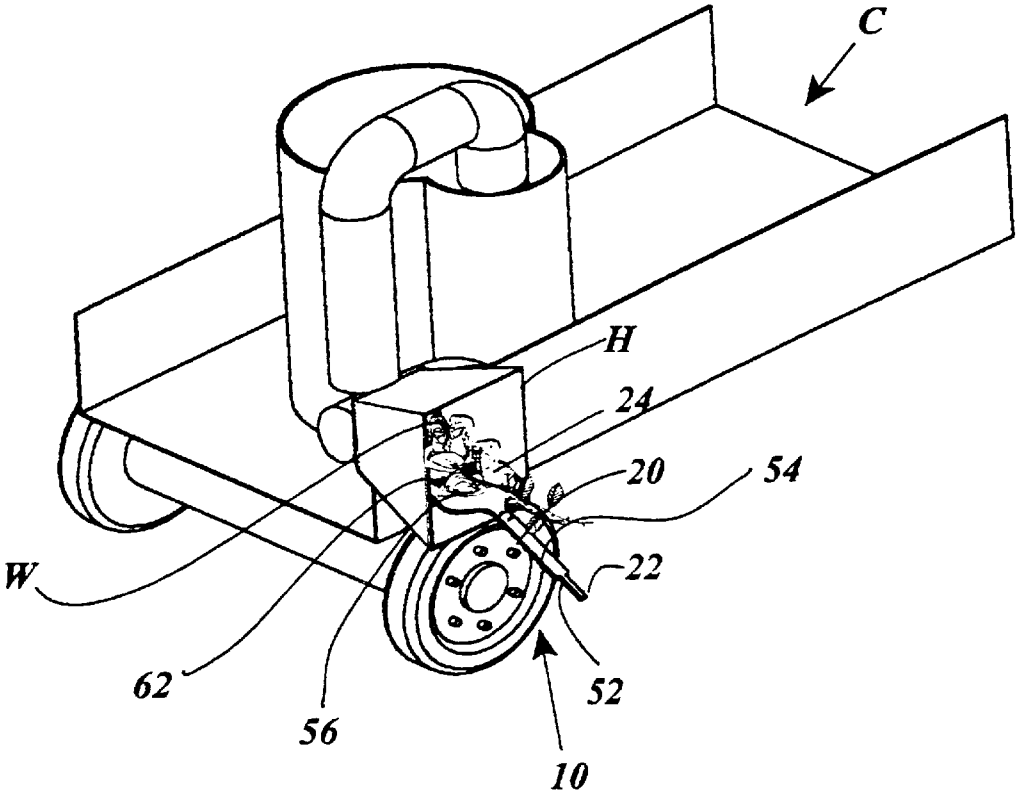
FIG. 8 is a perspective view of the pushing tool of the FIG. 7 pushing plant waste into the hopper of a wood chipper apparatus.
Figure 9:
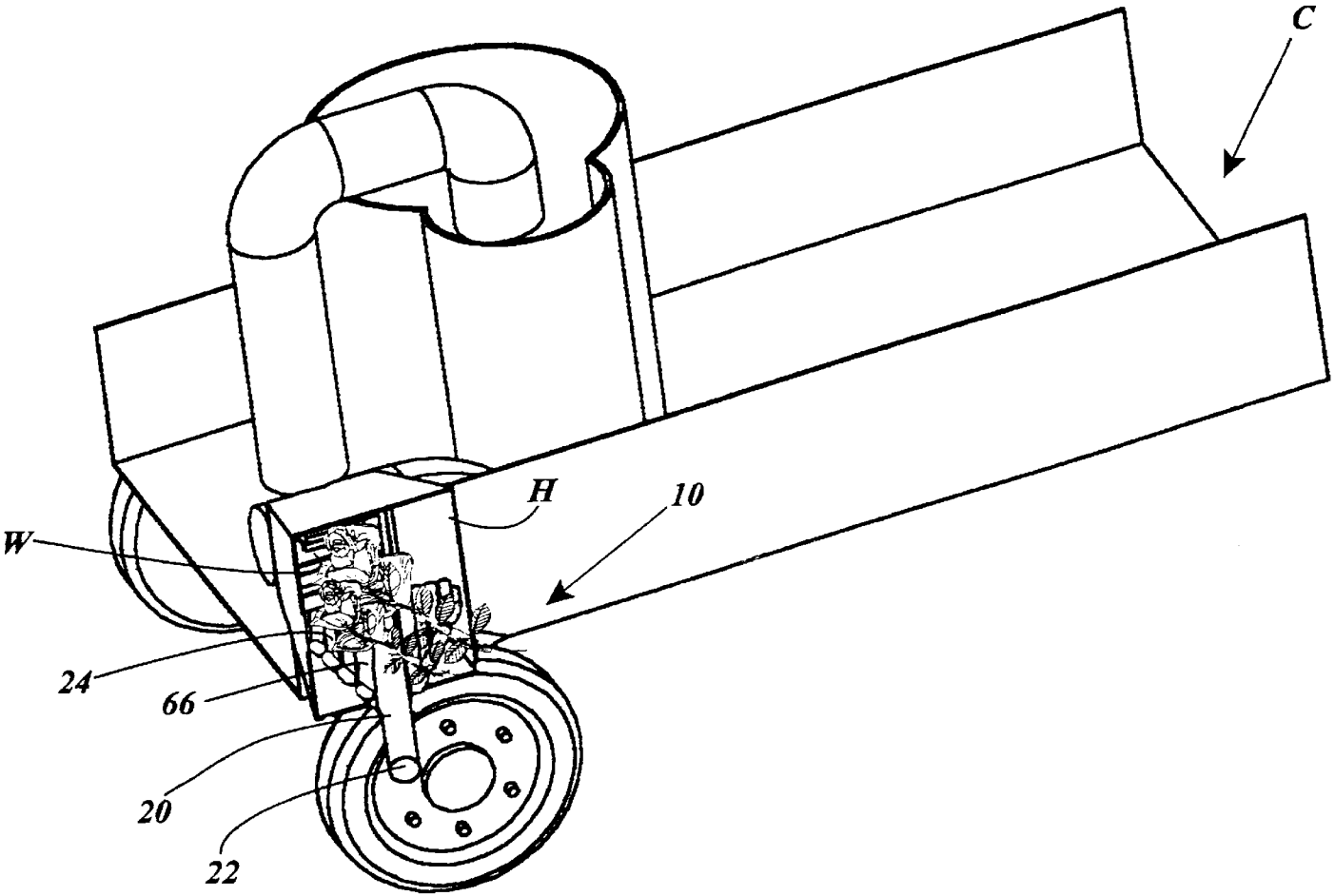
FIG. 9 is a perspective view of the pushing tool of the second version of the third embodiment pushing plant waste into the hopper of a wood chipper apparatus.
Figure 10:
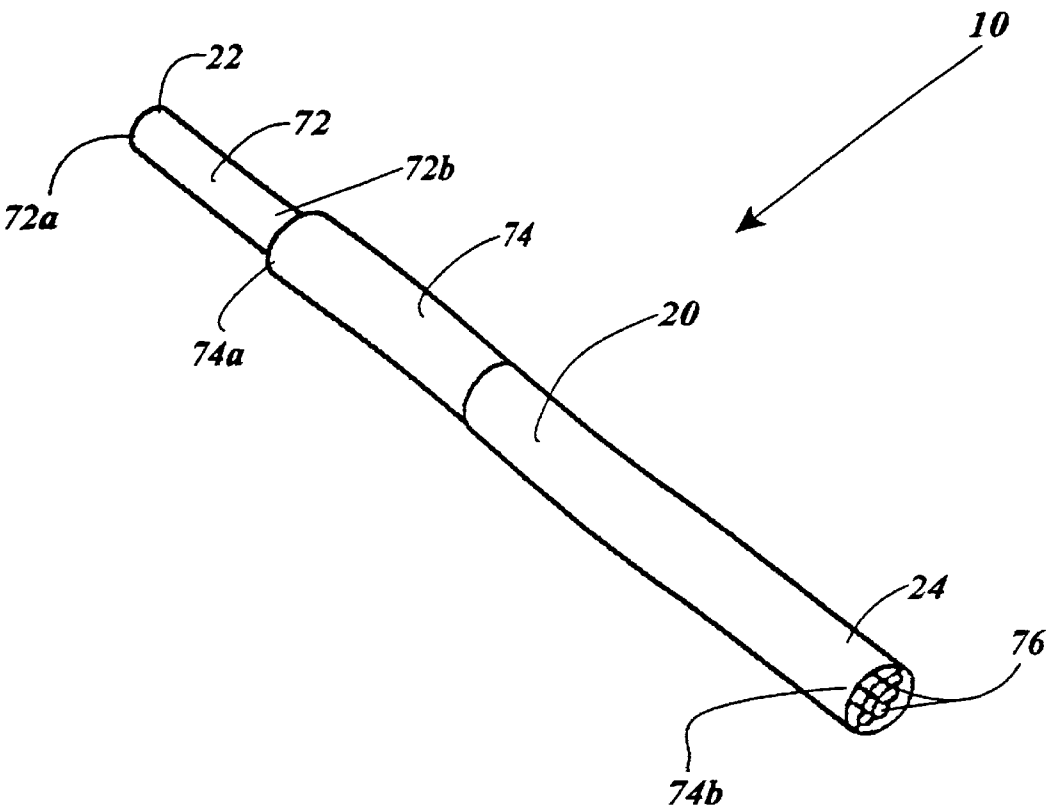
FIG. 10 is a distal end view of the pushing tool of the fourth embodiment.
Figure 11:
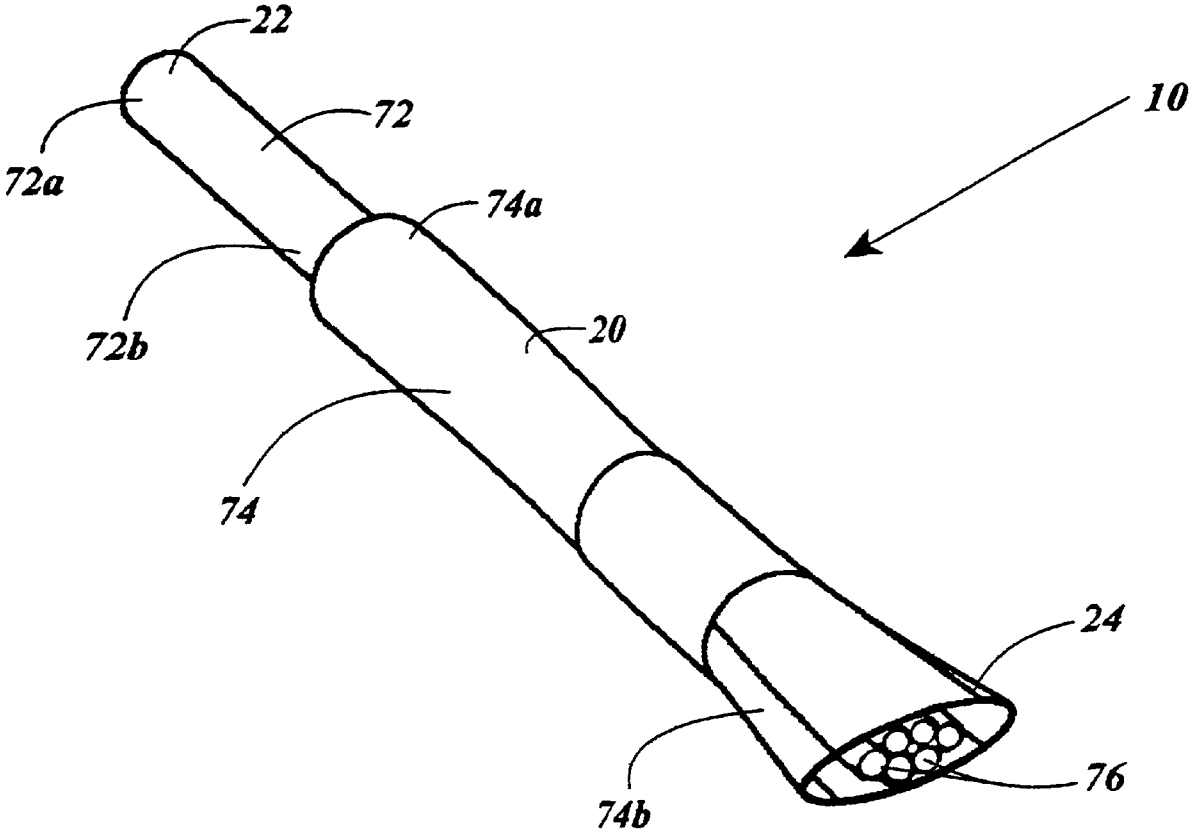
FIG. 11 is a view as in FIG. 10 of a flattened version of the pushing tool of the fourth embodiment.
Figure 12:
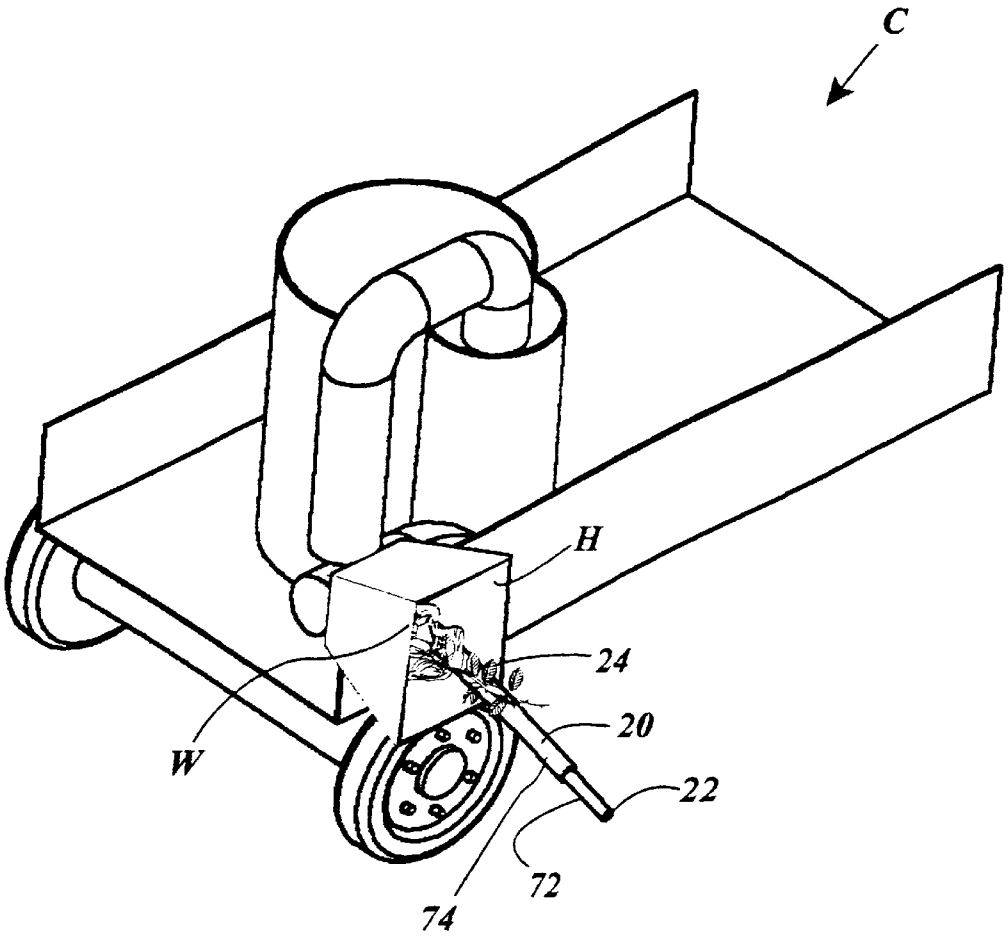
FIG. 12 is a perspective view of the pushing tool of the fourth embodiment pushing plant waste into the hopper of a wood chipper apparatus.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various FIGURES are designated by the same reference numerals.

The Invention Generally

Referring to FIGS. 1–12, a manually operated pushing tool 10 for pushing plant waste W into the plant waste receiving hopper H of a conventional wood chipper apparatus C as shown in FIG. 1 is disclosed. The wood chipper apparatus C and pushing tool 10 in combination may be viewed as a plant waste disposal system. Pushing tool 10 includes a disposable elongate member 20 made of biodegradable material, having a proximal member first end 22 narrow enough for gripping by hand and having a distal member second end 24 substantially wider than the member first end 22 for abutting and pushing plant waste into a hopper H. Member second end 24 preferably has a cross-section which is at least one and one half times, and preferably four times, the cross-section of member first end 22. The pushing tool 10 is constructed, either by choice of a suitable material or by its configuration, so that the member second end 24 breaks away when the member 20 is placed under substantial tensile loading, preferably at a tensile loading of five pounds. As a result, in the event the member 20 accidently becomes caught in the chipper apparatus C and is suddenly pulled into the plant waste fragmenting elements, the member second end 24 simply breaks away from the member first end 22 so that the worker hand which is gripping the member first end 22 is not pulled into the plant waste fragmenting elements.

The tool 10 material is also sufficiently soft and fragile that a conventional wood chipper apparatus C can chop or shred or otherwise fragment it without damage to the wood chipper C plant waste fragmenting elements. Yet the pushing tool 10 material has relatively high compressive strength so that it can push heavy plant fragments into the chipper apparatus C. The pushing tool 10 is thrown into the plant waste receiving hopper H and processed in the chipper apparatus C when the plant waste W processing job is completed or when the tool 10 becomes excessively worn from use, so that it is either discarded or recycled with the processed plant waste W. The pushing tool 10 is also made from a material which is highly inexpensive and biodegradable. Within the broadly stated shape parameters set forth above, the pushing tool 10 may take any of several preferred configurations.

First Preferred Embodiment

A first preferred embodiment of tool 10 is that of a hollow frusticone, having the general appearance of an elongate funnel, with the narrower end of the funnel being the member first end 22 for hand gripping and the wider end of the funnel being the member second end 24 for broadly bearing against unprocessed plant waste W and pushing the waste W into the plant waste receiving hopper H. See FIGS. 2–4. A variation of the first preferred embodiment is partially laterally flattened so that the funnel becomes generally elliptical, rectangular or triangular in cross-section, but has a member first end gripping segment 32 of circular cross-section for hand gripping and has an outwardly flared cone segment 34 linking the gripping segment 32 to the partially flattened frustoconic funnel and thus to the member second end 24.

Second Preferred Embodiment

A second preferred embodiment of tool 10 has a member first end 22 in the form of a solid shaft having a generally uniform and preferably rectangular cross-section and has a member second end 24 which flares outwardly from member first end 22 to define a hollow and open based pyramid with opposing lateral ports 42 to save member material and lower cost of manufacture. See FIGS. 5 and 6.

Third Preferred Embodiment

A third preferred embodiment of tool 10 is solid and substantially planar and has a narrow member first end 22 gripping segment 52 of substantially continuous and preferably square cross-section, a wider middle segment 54 of substantially continuous rectangular cross-section, and a member second end 24 including a broad region 56 having generally rectangular opposing faces and a member second end distal edge 62 with a series of pointed teeth 64 for engaging pieces of unprocessed plant waste W to help the worker guide the waste into the hopper H. See FIGS. 7 and 8. A variation of the third preferred embodiment has a broad region 66 at its member second end 24 which flares outwardly from the member first end 22 to define generally triangular opposing faces, the widest region being located at the member second end distal edge 62 to broadly abut and push plant waste W. See FIG. 9.

Fourth Preferred Embodiment

A fourth preferred embodiment of tool 10 has a member first end 22 in the form of a smaller diameter circular or elliptical cross-section first tube segment 72 having a first tube segment proximal end 72*a* and first tube segment distal end 72*b*, and a member second end 24 in the form of a larger diameter circular or elliptical cross-section second tube segment 74 having a second tube segment proximal end 74*a* and a second tube segment distal end 74*b*. See FIGS. 10–12. The second tube segment 74 preferably contains laterally abutting and glued together filler tubes 76 which also laterally abut and are glued to the inner surface of the second tube segment 74 for greatly enhanced axial compressive strength. The first tube segment 72 optionally contains laterally abutting and glued filler tubes 76 as well. The first tube segment distal end 72*b* preferably abuts the filler tubes 76 within the second tube segment 74 so that compressive force borne by the second tube segment 74 is directly transmitted into the first tube segment 72, but the first tube segment 72 is only lightly glued to the second tube segment 74 to readily break away in the event second tube segment 74 becomes caught in the chipper apparatus C plant waste fragmenting elements while being gripped by the worker. Other member 20 configurations are contemplated.

Examples of preferred materials from which the pushing tool 10 is formed are: cardboard, compressed pulp or paper, layered or compressed wood, wood fiber, biodegradable plastic sheets, rolled or layered paper, drywall material, and an artificial material known as CELLOTEX™. This list is not exhaustive and should not be viewed as limiting. Use of other materials is contemplated. The material should have good compressive strength, be readily fragmentable in a conventional wood chipper apparatus and be biodegradable and inexpensive.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

We claim:

1. A plant waste disposal system comprising:

a wood chipper apparatus having plant waste fragmenting means and having a plant waste receiving hopper;

and an elongate push member of biodegradable material having a member first end for gripping by hand and having a member second end of at least one and one half times the cross-sectional area of said member first end for abutting and pushing plant waste into said plant waste receiving hopper, said elongate member being constructed to fracture when subjected to tensile force in excess of five pounds, for preventing said elongate member from pulling a worker hand into said plant waste fragmenting means.

2. The plant waste disposal system of claim 1, wherein said elongate member is constructed of tool material which is sufficiently soft and fragile that said wood chipper apparatus can fragment said elongate member without damage to said plant waste fragmenting means.

3. The plant waste disposal system of claim 1, wherein said elongate member is shaped as a hollow frusticone having a narrower end defining said member first end for hand gripping and a wider end defining said member second end for broadly bearing against plant waste and pushing said waste into said plant waste receiving hopper.

4. The plant waste disposal system of claim 3, wherein said elongate member has a cross-sectional shape which is substantially one of: elliptical and triangular and rectangular.

5. The plant waste disposal system of claim 1, wherein said member first end is a shaft of substantially uniform cross-section and wherein said member second end flares outwardly from said member first end to define a hollow and open based pyramid.

6. The plant waste disposal system of claim 1, wherein said elongate member is substantially planar and has a member first end of substantially continuous first end cross-section, has a member middle segment of substantially continuous rectangular cross-section which is wider than said first end cross-section, and has a member second end comprising a broad region having generally rectangular opposing faces and a second end distal edge comprising a series of teeth for engaging plant waste to help the worker guide the plant waste into said plant waste receiving hopper.

7. The plant waste disposal system of claim 6, wherein said broad region flares progressively outwardly from said member first end to define substantially triangular opposing faces, the widest portion of said broad region being located at said second end distal edge for broadly abutting and pushing plant waste.

8. The plant waste disposal system of claim 1, wherein said elongate member comprises a member first end in the form of a smaller diameter first tube segment having a first tube segment proximal end and a first tube segment distal end, and a member second end in the form of a larger diameter second tube segment having a second tube segment proximal end axially joined to said first tube segment distal end and having a second tube segment distal end.

9. The plant waste disposal system of claim 8, wherein said first tube segment has a cross-section which is substantially one of: circular and elliptical.

10. The plant waste disposal system of claim 8, wherein said second tube segment has a cross-section which is substantially one of: circular and elliptical.

11. The plant waste disposal system of claim 8, additionally comprising a plurality of substantially mutually parallel and laterally abutting filler tubes extending substantially parallel to said elongate member and contained within said second tube segment, for increasing the compressive strength and buckling limit of said second tube segment.

12. The plant waste disposal system of claim 8, additionally comprising a plurality of mutually parallel and abutting filler tubes extending parallel to said elongate member and contained within said first tube segment, for increasing the compressive strength and buckling limit of said first tube segment.

13. The plant waste disposal system of claim 8, wherein said first tube segment distal end is releasibly joined to said second tube segment proximal end such that compressive force borne by said second tube segment is directly transmitted into said first tube segment, and wherein tensile force in excess of five pounds causes said first tube segment to break away from said second tube segment upon said second tube segment becoming caught in said plant waste fragmenting means while said first tube segment is gripped by a worker.

14. The plant waste disposal system of claim 1, wherein said elongate member is formed of at least one of: cardboard, compressed pulp, compressed paper, layered wood, compressed wood, wood fiber, biodegradable plastic sheets, rolled paper, layered paper and drywall material.

* * * * *